US009745179B2

(12) United States Patent
Jorgensen et al.

(10) Patent No.: US 9,745,179 B2
(45) Date of Patent: Aug. 29, 2017

(54) VEHICLE LIFT

(71) Applicant: Shinn Fu Corporation, Taipei (TW)

(72) Inventors: Ryan A. Jorgensen, Blue Springs, MO (US); Casey R. Gann, Camden Point, MO (US)

(73) Assignee: Shinn Fu Corporation, Taipei (TW)

( * ) Notice: Subject to any disclaimer, the term of this patent is extended or adjusted under 35 U.S.C. 154(b) by 0 days.

(21) Appl. No.: 14/813,123

(22) Filed: Jul. 30, 2015

(65) Prior Publication Data

US 2017/0029254 A1 Feb. 2, 2017

(51) Int. Cl.

| | |
|---|---|
| ***B66F 7/10*** | (2006.01) |
| ***B66F 3/00*** | (2006.01) |
| ***B66F 5/00*** | (2006.01) |
| ***B66F 5/04*** | (2006.01) |
| ***B66F 7/06*** | (2006.01) |

(52) U.S. Cl.

CPC ..... *B66F 7/10* (2013.01); *B66F 3/00* (2013.01); *B66F 5/00* (2013.01); *B66F 5/04* (2013.01); *B66F 7/0641* (2013.01)

(58) Field of Classification Search

CPC ..... B62B 1/26; B62B 2205/30; B66F 3/00; B66F 3/24; B66F 5/00; B66F 7/00; B66F 7/10; B66F 7/12; B66F 7/26; B66F 15/00; B66F 2700/00; B66F 2700/12

USPC ..... 414/785, 800; 254/2 B, 8 B, 9 B, 10 B, 254/116, 120, 122, 131, 133 R, 134

See application file for complete search history.

(56) References Cited

U.S. PATENT DOCUMENTS

| | | | | | |
|---|---|---|---|---|---|
| 826,035 | A * | 7/1906 | Jorgensen | B66F 5/00 | 414/743 |
| 984,328 | A * | 2/1911 | Way | B66F 5/00 | 414/743 |
| 2,903,258 | A * | 9/1959 | Jovanovich | B25H 1/0007 | 248/176.1 |
| 3,029,065 | A * | 4/1962 | Buddingh | B66F 15/00 | 254/124 |
| 3,306,579 | A * | 2/1967 | Campbell | B62B 3/0625 | 254/10 R |
| 3,734,466 | A * | 5/1973 | Mason | B66F 7/22 | 254/134 |
| 4,979,592 | A * | 12/1990 | Isogai | B65G 69/24 | 187/217 |
| 5,143,352 | A | 9/1992 | Latimer | | |
| 5,145,154 | A | 9/1992 | Bastille et al. | | |

(Continued)

*Primary Examiner* — Charles A. Fox
*Assistant Examiner* — Joseph J Sadlon
(74) *Attorney, Agent, or Firm* — Lathrop Gage LLP

(57) ABSTRACT

A device for lifting a small vehicle having a frame and a hood includes a lifting mechanism configured to move a platform from a lowered position to a raised position; and a saddle attached to the platform. The saddle has a top plate having a front side and a back side, opposed first and second side plates extending vertically in a first direction, and a lip extending vertically in a second direction. A supporting member extends outwardly from the top plate. An elbow has a first portion releasably coupled to the supporting member, and a second portion extending upwardly from the first portion. A hook disposed on a threaded handle attaches to the second portion of the elbow and is configured to move between a lowered position and raised position. The lip engages with the frame of the vehicle, and the hook fastens to a portion of the hood.

20 Claims, 8 Drawing Sheets

(56) References Cited

U.S. PATENT DOCUMENTS

| | | | | |
|---|---|---|---|---|
| 5,211,265 | A * | 5/1993 | Gregg | B66F 7/08 187/211 |
| 5,378,004 | A * | 1/1995 | Gunlock | B62B 1/002 254/8 B |
| 5,380,140 | A * | 1/1995 | Johnson | B62D 51/007 414/421 |
| 5,618,030 | A * | 4/1997 | Eggert | B66F 15/00 254/131 |
| 6,050,546 | A * | 4/2000 | Peschmann | B66F 5/025 254/10 B |
| 6,241,227 | B1 | 6/2001 | Berdan et al. | |
| 6,474,626 | B1 * | 11/2002 | Box | A01D 34/001 254/120 |
| 6,966,542 | B2 | 11/2005 | Bettencourt | |
| 8,052,120 | B2 * | 11/2011 | Bacon | B66F 7/0625 180/168 |
| 8,448,921 | B2 | 5/2013 | Hernandez | |
| 2006/0245873 | A1 | 11/2006 | Black | |
| 2006/0278855 | A1 * | 12/2006 | Krug | B66F 7/02 254/4 B |

* cited by examiner

VEHICLE LIFT

BACKGROUND

It is desirable to lift vehicles for numerous reasons—in order to repair the vehicle or for storage purposes, for example. Many lifts are designed for use with two-axel, four-wheeled vehicles, where the lift can support the weight of the vehicle by its position under the wheels of the vehicle, under the axels, or both. Lifts are also needed for other types of vehicles, such as snowmobiles and watercraft. However, these vehicles present unique lifting challenges, specifically where the vehicles do not have wheels or axels.

SUMMARY

The following presents a simplified summary of the invention in order to provide a basic understanding of some aspects of the invention. This summary is not an extensive overview of the invention. It is not intended to identify critical elements of the invention or to limit the scope of the invention. Its sole purpose is to present some concepts of the invention in a simplified form as a prelude to the more detailed description presented below.

In one embodiment, a device for lifting a small vehicle having a frame and a hood includes a lifting mechanism configured to move a platform from a lowered position to a raised position; and a saddle configured to attach to the platform. The saddle has a top plate having a front side and a back side, opposed first and second side plates extending vertically in a first direction from the top plate between the front side and the back side, and a lip extending vertically in a second direction from the top plate back side. At least one supporting member extending outwardly from the top plate front side. An elbow has a first portion releasably coupled to the supporting member, and a second portion extending upwardly from the first portion. Finally, a hook is disposed on a threaded handle, the handle being attached to the second portion of the elbow and configured to move between a lowered position and raised position. The lip engages with a back portion of the frame of the vehicle, and the hook fastens to a portion of the hood such that the top plate substantially supports the weight of the vehicle when the platform is in the raised position.

In another embodiment, a device for lifting a vehicle includes a lifting mechanism configured to move a platform from a lowered position to a raised position; and a saddle removably attached to the platform. The saddle has a top plate with a front side and a back side, and the back side has a lip extending upwardly therefrom. At least one supporting member extends horizontally from the top plate front side, an elbow is releasably coupled to the supporting member; and a hook is disposed on a handle attached to the elbow. The handle is configured to move between a lowered position and raised position. The lip engages with a back portion of the frame of the vehicle, and the hook fastens to a portion of the hood such that the top plate substantially supports the weight of the vehicle when the lifting mechanism is in the raised position.

In yet another embodiment, a method for lifting a small vehicle comprises the steps of: providing a vehicle having a frame and a hood; providing a lifting device in a lowered position, the lifting device being equipped with a saddle; positioning the lifting device under the vehicle such that the lip engages a portion of the vehicle frame; adjusting the hook to engage a portion of the hood of the vehicle; and causing the lifting mechanism to move from the lowered position to a raised position. The saddle has a top plate having a lip formed thereon; at least one supporting member extending outwardly from the top plate; an elbow adjustably coupled to the supporting member; and a hook disposed on a handle attached to the elbow, the handle being configured to translate between a lowered position and a raised position.

DETAILED DESCRIPTION

Non-traditional vehicles such as snowmobiles present unique lifting challenges. For example, while it may be acceptable to lift a four-wheeled vehicle by supporting the wheels of the vehicle, snowmobiles do not have wheels, but rather a single track running along a length of the snowmobile. It is not ideal to store a snowmobile on its track, as it is particularly prone to damage if the weight of the snowmobile is supported on the track for an extended duration. Additionally, storing the snowmobile on its tracks may cause damage to the suspension. Moreover, should the tracks need to be removed to complete work on the snowmobile or the tracks, traditional lifts are not configured to support the snowmobile. Other non-traditional vehicles, such as watercraft may similarly benefit from specialized vehicle lifts.

Figure 1:
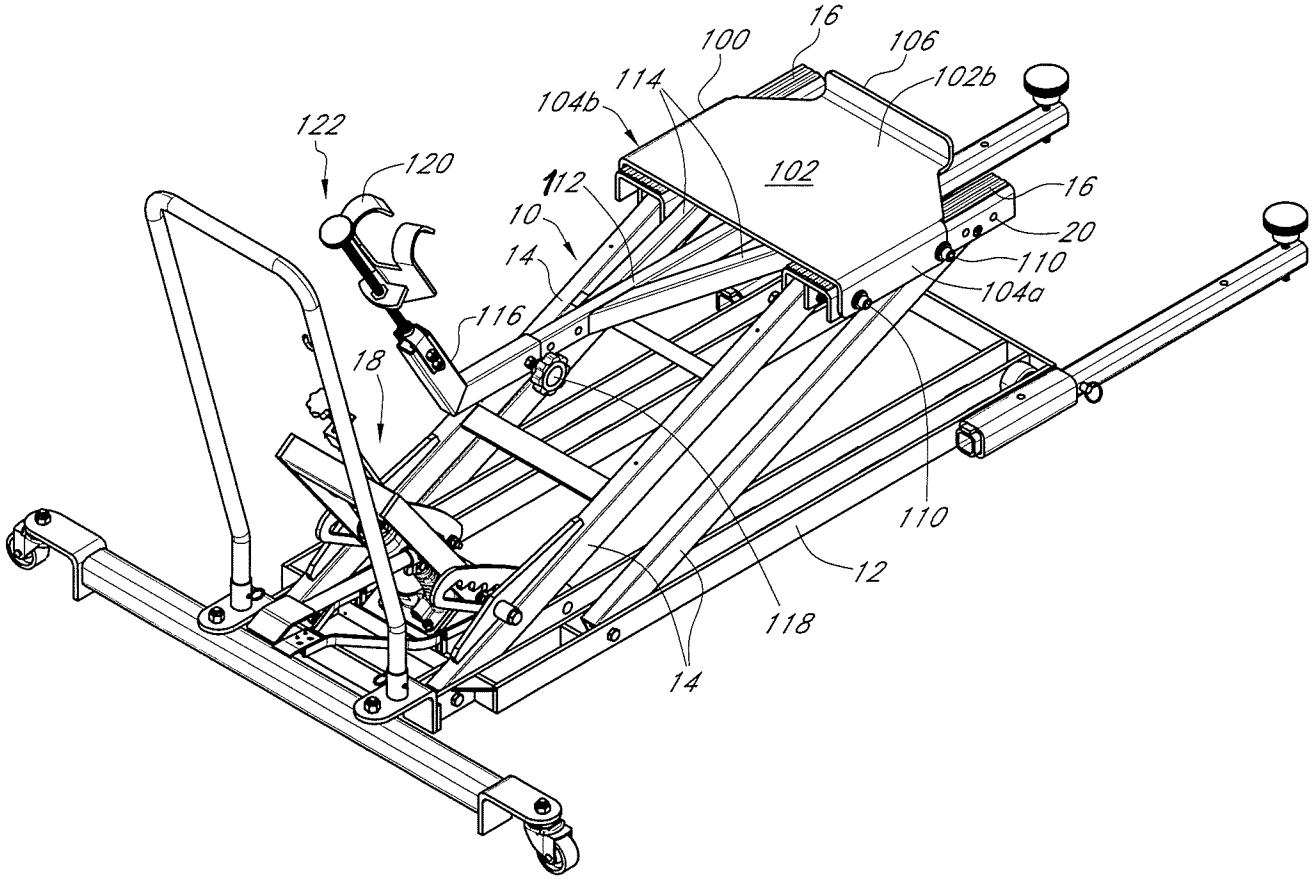
FIG. 1 is a perspective view of a vehicle lift according to one embodiment of the invention.
Figure 2:
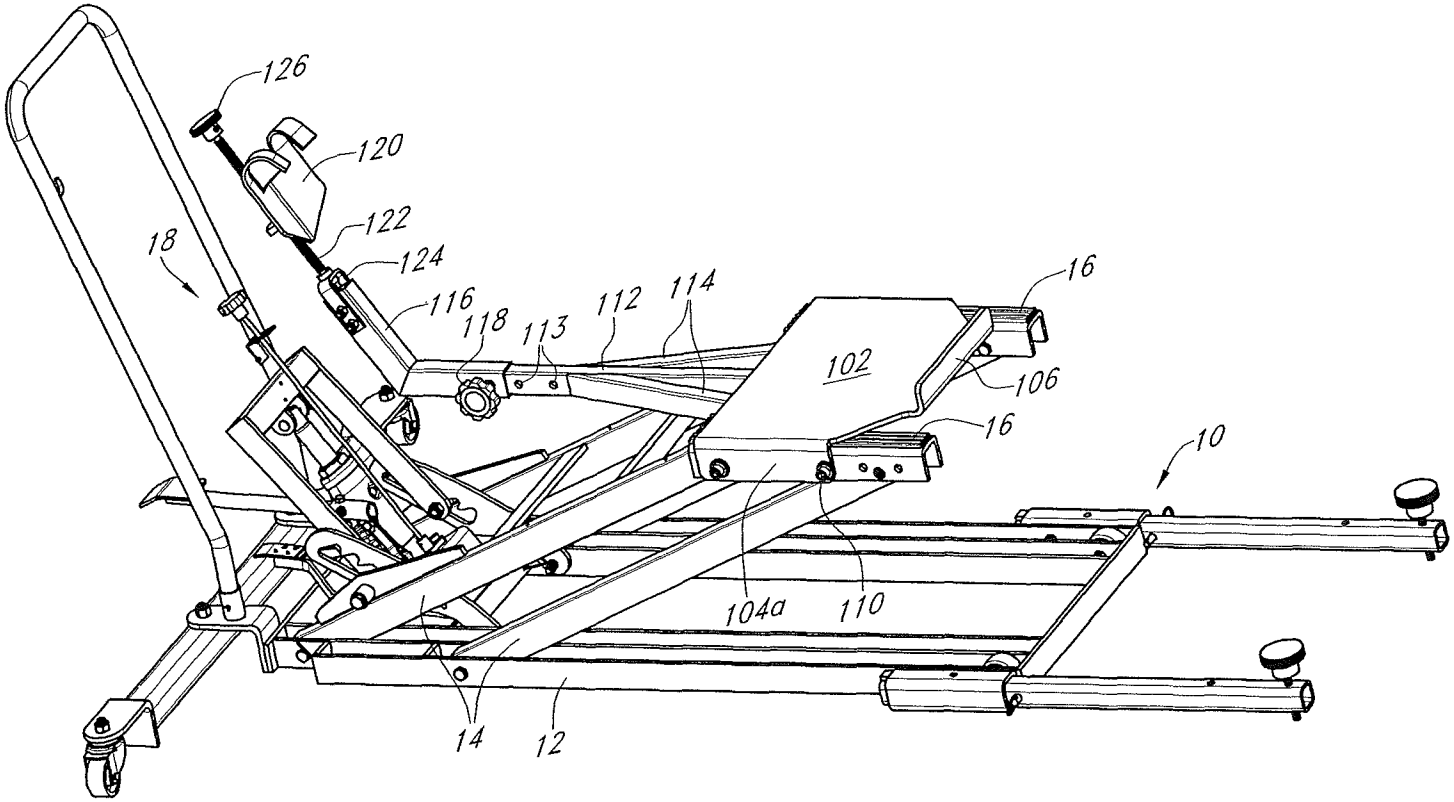
FIG. 2 is another perspective view of the invention of FIG. 1.
Figure 3:
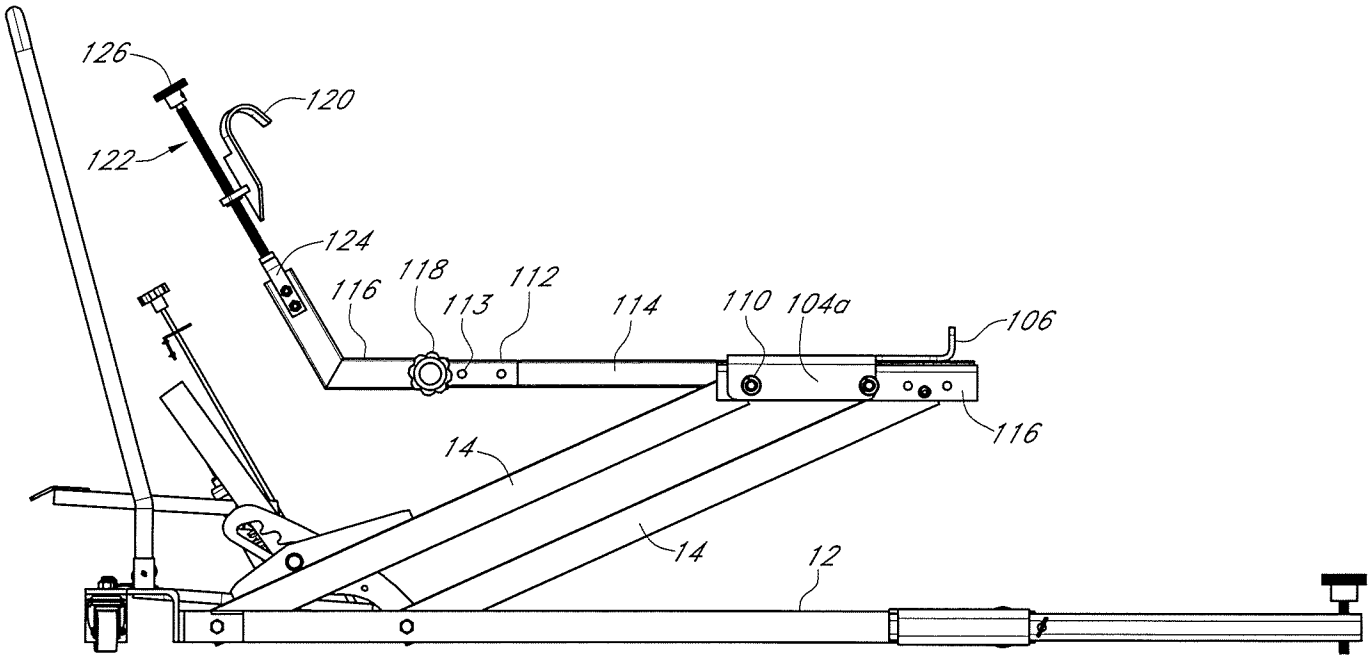
FIG. 3 is a side view of the invention of FIG. 1.

Embodiments of non-traditional vehicle lifts are described herein. With reference to FIGS. 1-3, a vehicle lift may include a lifting mechanism 10 and a saddle 100 for supporting the weight of a vehicle. The lifting mechanism 10 may be any type of commercially available jack. Exemplary types of jack may include those described in U.S. Pat. Nos. 8,469,338 and 8,608,130. The jack may at least include a base 12, arms 14, a platform 16, and means 18 for raising the platform 16, although other features may also (or alternately) be present.

Figure 4:
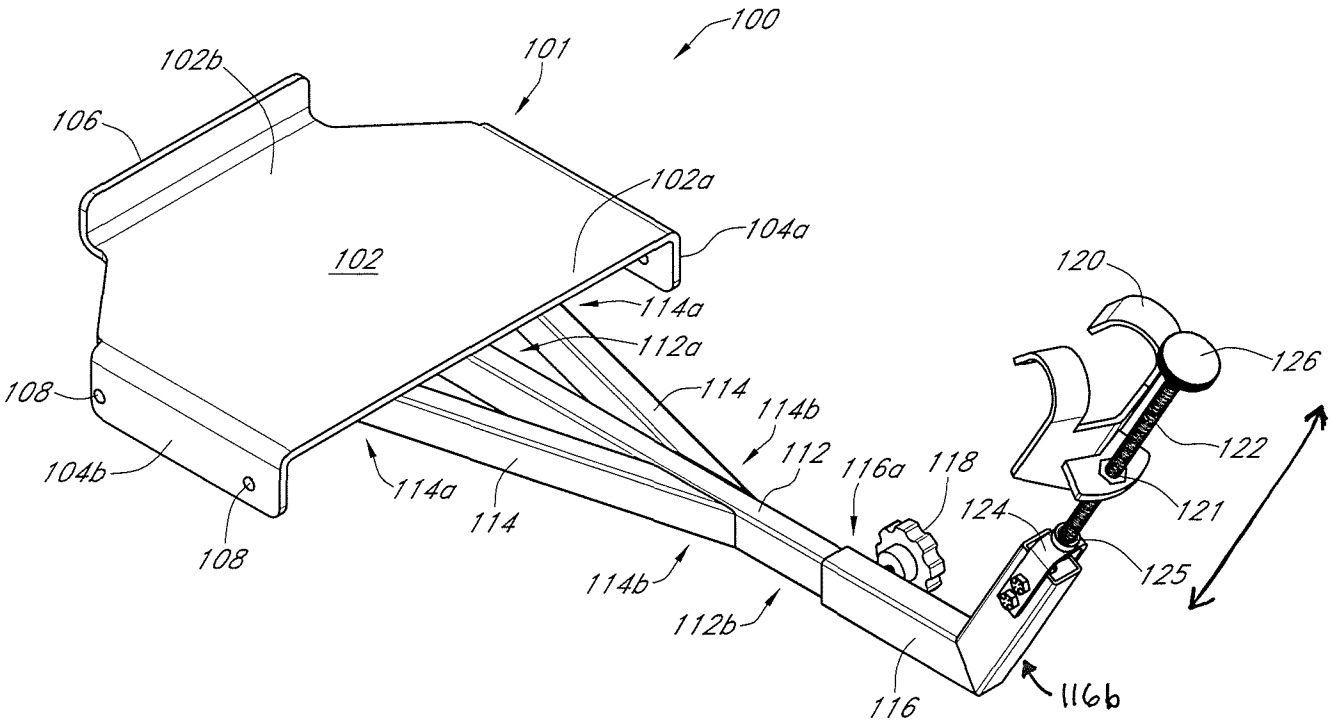
FIG. 4 is a top perspective view of a saddle for a vehicle lift according to the invention of FIG. 1.
Figure 5:
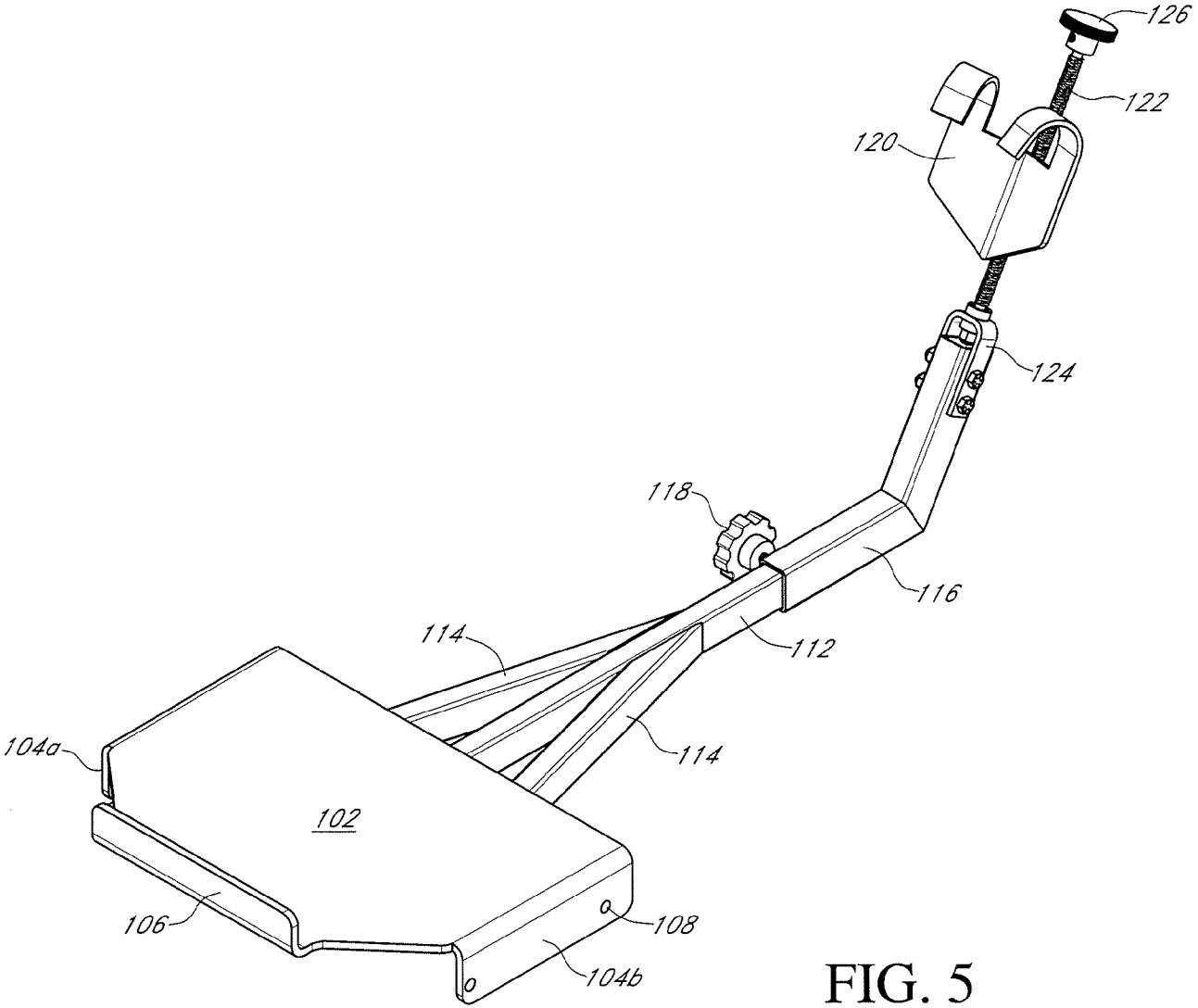
FIG. 5 is another top perspective view of the saddle for a vehicle lift according to the invention of FIG. 1.
Figure 6:
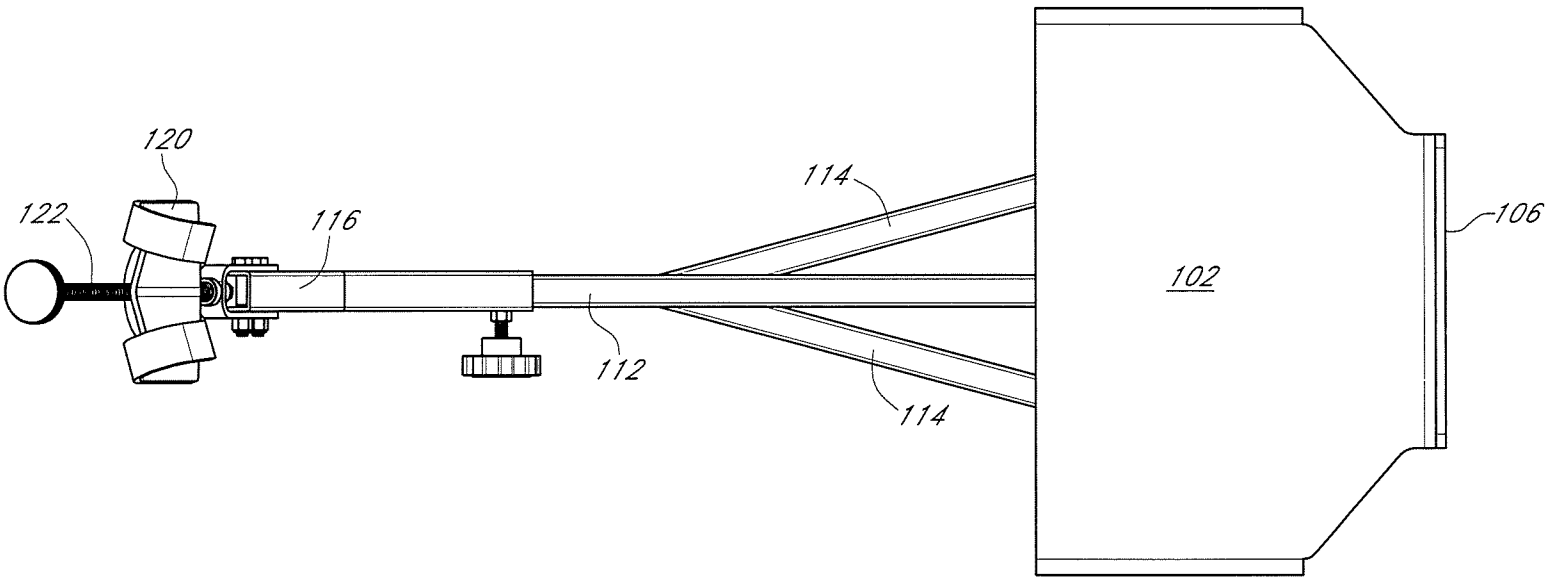
FIG. 6 is a top view of the saddle for a vehicle lift according to the invention of FIG. 1.

As illustrated in FIG. 4, the saddle 100 may include a plate portion 101, supporting members 112 and 114, an elbow 116 having a first portion 116*a* and a second portion 116*b*, and a hook 120. The saddle 100 may be configured to attach to the jack 10 such that the jack 10 may support a non-traditional vehicle (200, FIG. 7). In one embodiment, the saddle 100 may include a top plate 102 having a front side 102*a* and a back side 102*b*. The top plate 102 is disposed between two opposing side plates 104*a* and 104*b*. The opposing side plates 104*a* and 104*b* may extend downwardly from the top plate 102. The backside 102*b* of the top plate 102 may be tapered toward the center of the plate 102, culminating in a lip 106 which may extend upwardly from the backside 102*b* of the top plate 102 as shown in the figures. As described in greater detail below, the lip 106 may be configured to engage with the frame 205 of the vehicle 200 to support the vehicle 200 in a lifted position.

The opposing side plates 104*a* and 104*b* may have holes 108 drilled therein for attaching the saddle 100 to the jack 10. Accordingly, the jack 10 may have corresponding holes 20. To attach the saddle 100 to the jack 10, the holes 108 in the saddle 100 are matched up with the holes 20 in the jack 10. Mechanical fasteners 110 may be selectively received through the holes 108 in the saddle 100 and the holes 20 in the jack 10 to secure the saddle 100 to the jack 10. Acceptable mechanical fasteners may include, but are not limited to nuts and bolts, screws, bolt and cotter pins, rivets, clamps, et cetera.

The top plate 102 may be positioned atop support members 112 and 114. Support members 112 and 114 may each include a distal end 112*a* and 114*a* and a proximal end 112*b* and 114*b*. The distal end 112*a* of the support member 112 may be located near the back side 102*b* of the top plate 102 and may extend outwardly therefrom toward the front side 102*a* of the top plate 102. The proximal end 112*b* of the support member 112 may further extend outwardly from the front side 120*a* of the top plate 102.

Proximal ends 114*b* of the support members 114 may bisect the support member 112 between the distal end 112*a* and the proximal end 112*b*. The distal ends 114*a* of the support members 114 may be respectively located near the tapered portion of the back side 102*b* of the top plate 102.

The support members 114 may be adhered to the support member 112 using any appropriate method, including but not limited to welding, chemical bonding, mechanical fastening, et cetera. Similarly, the top plate 102 may be adhered to the support members 112 and 114 using similar methods. It will be understood by those of skill in the art that the method selected for attaching the support members 114 to the support member 112 does not have to be the same method selected for attaching the support members 112 and 114 to the top plate 102.

The proximal end 112*b* of the support member 112 may be configured to be received by the elbow 116. The elbow 116 may have a hole formed therein configured to receive a screw knob 118 for securing the elbow 116 to the support member 112. As is described more particularly below, to facilitate various lengths of vehicles, the proximal end 112*b* of the support member 112 may have several apertures 113 (FIGS. 1 and 2) formed therein. When the support member 112 is received by the elbow 116, the hole in the elbow 116 may be matched with a corresponding aperture in the support member 112, and the screw knob 118 may be secured therein. Alternately, the support member 112 may not have apertures therein, and the screw knob 118 may be inserted through the hole in the elbow 116 and securely tightened against an outside surface of the support member 112.

As mentioned above, a hook 120 may be provided to further support the vehicle 200 when in a raised position by engaging the nose 210 of the vehicle 200. The hook 120 may be secured to the elbow 116 via a bracket 124 and threaded handle 122. The bracket 124 may be attached to the elbow 116, (for example, via nuts and bolts, pins, et cetera) and may be configured to receive the threaded handle 122 through a threaded portion 125. The hook 120 may be threaded onto the handle 126 via a threaded receiving portion 121 on the hook 120. Alternately the hook 120 may be otherwise attached to the handle 126 (e.g., weld, adhesive, etc).

Depending on the length of the vehicle 200, the distance between the lip 106 and the hook 120 may need to be adjusted. To facilitate the adjustment, the elbow 116 may be translated on the support member 112. To adjust the position of the elbow 116, the screw knob 118 may be released from its position such that the elbow 116 can slide along the support member 112. To shorten the distance, the elbow 116 is moved toward the top plate 102 and the screw knob 118 is tightened to maintain the elbow 116 in the desired position. To lengthen the distance, the elbow 116 is moved away from the top plate 102 according to the same process.

The height of the hook 120 may also need to be adjusted based on the height of the nose 210 of the vehicle 200. Accordingly, the hook 120 may be raised or lowered by turning the threaded handle 122 via knob 126, thus causing the handle 126 to move up or down in the bracket 124.

The saddle 100 may be formed from any appropriate material. It may be recognized by those of skill in the art that it is desirable for the saddle 100 to be configured to support the weight of a vehicle. Accordingly, exemplary materials that may be used to construct the saddle include steel, aluminum, titanium, et cetera.

Figure 7:
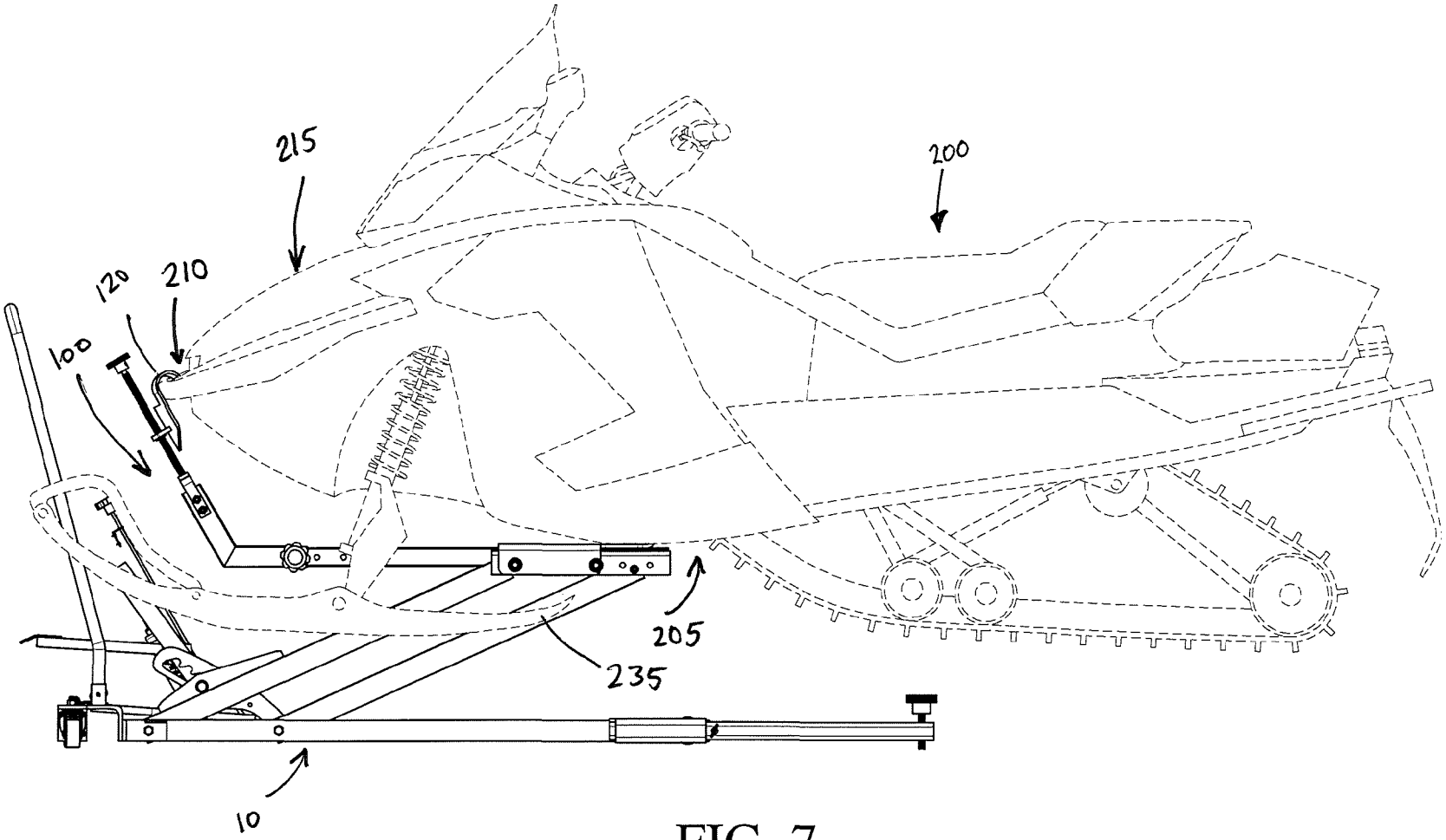
FIG. 7 is a side view of the vehicle lift holding a vehicle according to an embodiment of the invention.
Figure 8:
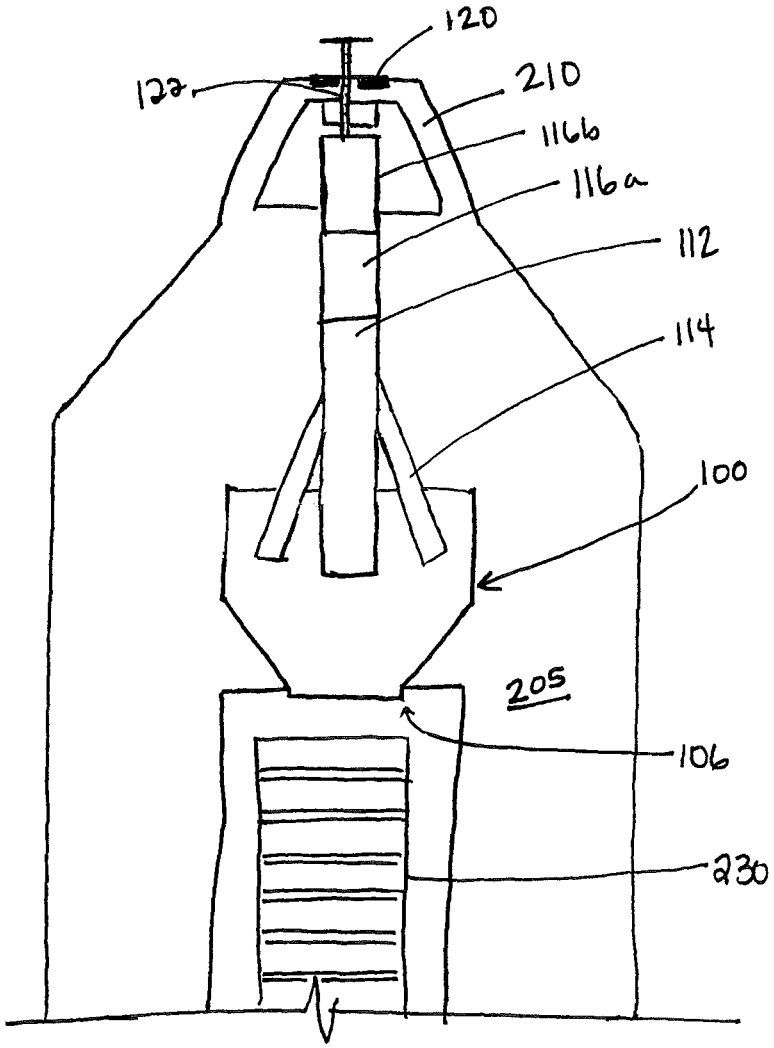
FIG. 8 is a bottom view of the vehicle lift holding a vehicle according to the embodiment of FIG. 7.

Referring now to FIGS. 7-8, in use, the saddle 100 is first attached to the jack 10. With the jack 10 in a lowered position, the jack 10 is positioned under the frame 205 of the vehicle 200 such that the lip 106 engages with the frame 205 of the vehicle 200. It may be determined that the length of the saddle 100 needs to be adjusted. Accordingly, the elbow 116 may be adjusted on the support member 112 (e.g., via apertures 113) such that the hook 120 may engage with the nose 210 at the hood 215 of the vehicle 200. It may be desirable to lower the hook 120 on the nose 210 of the vehicle 200 to ensure that the vehicle 200 is properly supported by the saddle 100.

Once the saddle 100 is engaged with the frame 205 and the nose 210 of the vehicle 200, the vehicle 200 may be lifted by the jack 10 according to the lifting mechanism of the particular jack 10. Once the vehicle 200 is lifted, work may be completed on various parts of the vehicle 200 (e.g., the tracks 230 and 235), or the vehicle 200 may be stored in an elevated position during the period of non-use.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. The specific configurations and contours set forth in the accompanying drawings are illustrative and not limiting. All steps need not be performed in the order shown or described.

What is claimed is:

1. A device for lifting a small vehicle, the vehicle having a frame and a hood, the device comprising:

a lifting mechanism configured to move a platform from a lowered position to a raised position; and a saddle configured to attach to the platform, the saddle comprising:

a top plate having a front side and a back side and:

opposed first and second side plates extending vertically in a first direction from the top plate between the front side and the back side, and a lip extending vertically in a second opposing direction directly from the top plate back side;

a supporting member extending outwardly from the top plate front side;

an elbow having a first portion releasably coupled to the supporting member, and a second portion extending upwardly from the first portion;

a hook disposed on a threaded handle, the handle being attached to the second portion of the elbow and configured to move between a lowered position and raised position; and wherein the lip engages with the frame of the vehicle, and the hook fastens to a portion of the hood such that the top plate substantially supports the weight of the vehicle when the platform is in the raised position.

2. The device of claim 1, wherein the opposed first and second side plates of the saddle are removably secured to the platform via a plurality of mechanical fasteners selected from the group consisting of: nuts and bolts, bolts and cotter pins, rivets, screws, and clamps.

3. The device of claim 2, wherein the saddle is maintained in a substantially horizontal position when the lifting mechanism moves the platform from the lowered position to the raised position.

4. The device of claim 3, wherein the elbow first portion is secured to the supporting member with a screw knob inserted through a hole in the elbow first portion, the screw knob being tightened firmly against the supporting member.

5. The device of claim 4, wherein the vehicle is a snowmobile.

6. The device of claim 5, wherein, in the raised position, a track of the snowmobile is unhindered.

7. The device of claim 6, wherein the support member comprises a plurality of support members, wherein:

a first support member extends linearly outwardly from the top plate, the elbow being attached thereto; and a second support member extends at a horizontal angle from the top plate and bisects the first support member.

8. The device of claim 7, wherein the support members are welded to a bottom side of the top plate.

9. The device of claim 8, wherein the threaded handle is attached to the elbow via a bracket having a threaded portion therein, and wherein the threaded handle engages with the threaded portion of the bracket such that, when twisted, the handle moves between the lowered position and the raised position.

10. The device of claim 9, wherein the saddle is manufactured from steel.

11. A device for lifting a vehicle, comprising:

a lifting mechanism configured to move a platform from a lowered position to a raised position;

a saddle removably attached to the platform, the saddle comprising:

a top plate having a front side and a back side, the back side having a lip extending directly upwardly therefrom beyond the top plate;

a supporting member extending horizontally from the top plate front side;

an elbow releasably coupled to the supporting member; and a hook disposed on a handle attached to the elbow, the handle being configured to move between a lowered position and raised position;

wherein the lip engages with a back portion of a frame of the vehicle, and the hook fastens to a portion of a hood of the vehicle such that the top plate substantially supports the weight of the vehicle when the lifting mechanism is in the raised position.

12. The device of claim 11, wherein the handle is attached to the elbow with a bracket, the bracket being mechanically fastened to the elbow.

13. The device of claim 12, wherein the elbow has an aperture formed therein; and wherein a screw knob is selectively received into the aperture of the elbow to secure the elbow to the supporting member.

14. The device of claim 13, wherein the saddle is removably secured to the platform via a plurality of mechanical fasteners selected from the group consisting of: nuts and bolts, bolts and cotter pins, rivets, screws, and clamps.

15. The device of claim 14, wherein the saddle is maintained in a substantially horizontal position when the platform is moved from the lowered position to the raised position.

16. The device of claim 15, wherein the at least one support member is welded to a bottom side of the top plate.

17. The device of claim 16, wherein the saddle is manufactured from at least one material selected form the group consisting of: steel, aluminum, titanium, and iron.

18. A method for lifting a small vehicle, comprising the steps of:

providing a vehicle having a frame and a hood;

providing a lifting device in a lowered position, the lifting device being equipped with a saddle, the saddle comprising:

a top plate having a lip formed thereon, the lip extending directly upwardly from the top plate;

at least one supporting member extending outwardly from the top plate;

an elbow having a first portion and a second portion extending upwardly from the first portion, the elbow first portion being adjustably coupled to the at least one supporting member; and a hook disposed on a handle attached to the elbow, the handle being configured to translate between a lowered position and a raised position;

positioning the lifting device under the vehicle such that the lip engages a portion of the vehicle frame;

adjusting the hook to engage a portion of the hood of the vehicle;

causing the lifting device to move from the lowered position to a raised position.

19. The method of claim 18, wherein, when the lifting device is moved from the lowered position to the raised position, the vehicle is maintained in a substantially horizontal position.

20. The method of claim 19, wherein a screw knob is selectively received through a hole in the elbow, the screw knob being securely tightened against an outside surface of the supporting member.

* * * * *